US007309179B2

(12) United States Patent
Toran et al.

(10) Patent No.: US 7,309,179 B2
(45) Date of Patent: Dec. 18, 2007

(54) MEDIA ADVANCING DEVICE AND METHOD OF DISPLACING A MEDIUM

(75) Inventors: Jose Miguel Toran, Barcelona (ES); Xavier Gros, Barcelona (ES); Raimon Castells, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 8 days.

(21) Appl. No.: 11/117,463

(22) Filed: Apr. 29, 2005

(65) Prior Publication Data

US 2006/0245810 A1 Nov. 2, 2006

(51) Int. Cl.
*B41J 11/00* (2006.01)

(52) U.S. Cl. ..... 400/648; 347/152; 347/88; 347/104

(58) Field of Classification Search ..... 347/152, 347/104, 88; 346/134, 141; 400/468
See application file for complete search history.

(56) References Cited

U.S. PATENT DOCUMENTS 5,124,728 A * 6/1992 Denda ..... 346/134
5,150,131 A * 9/1992 Le Jaoudour ..... 346/134
6,196,672 B1 * 3/2001 Ito et al. ..... 347/88
6,234,472 B1 * 5/2001 Juan ..... 271/194
6,270,215 B1 * 8/2001 Miyasaka et al. ..... 347/104
6,280,106 B1 * 8/2001 Juan et al. ..... 400/605
6,367,999 B1 * 4/2002 Juan et al. ..... 400/645
6,491,462 B1 * 12/2002 Juan et al. ..... 400/703
6,554,415 B2 * 4/2003 Juan ..... 347/102
6,554,514 B2 * 4/2003 Wotton et al. ..... 400/648
6,565,081 B1 * 5/2003 Perez et al. ..... 271/183
6,786,664 B2 * 9/2004 Claramunt et al. ..... 400/656
6,873,821 B2 * 3/2005 Russel et al. ..... 399/400
2003/0080501 A1 * 5/2003 Perez et al. ..... 271/276
2004/0239742 A1 * 12/2004 Hiraki et al. ..... 347/104

* cited by examiner

*Primary Examiner*—Ren Yan
*Assistant Examiner*—Matthew Marini

(57) ABSTRACT

A media advancing device for a hardcopy apparatus comprising: a platen having at least one slot and a top surface, whereby a medium advances on the top surface; and a plurality of openings connecting the top surface to at least one zone of negative pressure; and a revolving overdrive roller having an outer surface, the outer surface emerging above the top surface through the slot, the overdrive roller being substantially sealed in a housing below the top surface, the housing separating the overdrive roller from the zone of negative pressure.

13 Claims, 5 Drawing Sheets

MEDIA ADVANCING DEVICE AND METHOD OF DISPLACING A MEDIUM

BACKGROUND OF THE INVENTION

1. Field of the Invention

The present invention generally relates to hardcopy apparatus, such as copiers, printers, scanners, and facsimiles, and more particularly to improved media advancing devices for such apparatus.

2. Description of the Prior Art

In hardcopy apparatuses and particularly in apparatuses handling media of large size, such as large format printers, a printed medium is outputted from the printer by outputting devices that may damage the quality of the printout. Conventional outputting devices, in order to advance printed media, employ elements for holding the medium having direct contact with the printed surface. This may cause markings on the medium, ink smearing and other adverse affects on the print appearance.

As an example, the prior art has employed pinch wheels on top of the overdrive roller for outputting printed media. These devices may damage the printout with pinch wheel marks and further require the need to employ a mechanism or a structure to hold the pinch wheels.

To overcome the problem of adverse affects on the print appearance, U.S. Pat. No. 6,786,664 discloses a device for advancing a medium on a platen including a combination of an overdrive roller with a negative pressure mechanism, a shim being provided in the gap between the platen and the overdrive roller. Thus, the shim allows controlling the entrance for air through the gap between the platen and the overdrive roller. However, the presence of the shim on the platen creates a mechanical discontinuity which may impact negatively on the smooth displacement on the medium and could cause dirt accumulation. In any case, the shim can only prevent entrance of air in the gap if it comes directly in contact with the roller, leading to creating friction when the roller rotates.

The present invention provides an improved media advancing device and an improved method of displacing a medium.

SUMMARY OF THE INVENTION

In its first main aspect, the invention relates to a media advancing device for a hardcopy apparatus comprising: a platen having at least one slot and a top surface, whereby a medium advances on the top surface; and a plurality of openings connecting the top surface to at least one zone of negative pressure; and a revolving overdrive roller having an outer surface, the outer surface emerging above the top surface through the slot, the overdrive roller being substantially sealed in a housing below the top surface, the housing separating the overdrive roller from the zone of negative pressure.

Hardcopy apparatuses include devices such as photocopiers, printers, scanners or typewriters handling media typically in the form of sheets or rolls. The material forming the medium may be of different types but generally includes paper, cardboard, plastic resins, woven or unwoven fibers or textile or mixtures between two or more of these materials. Among these, the invention demonstrated more particularly of use when applied to printing devices, more specifically ink jet printers, even more specifically thermal ink jet printers.

The invention was proven particularly suitable when applied to apparatuses handling large format media. By large format, it is meant a format larger than about 8.26 inches by about 11.69 inches. A reason for this is that such large format apparatuses are commonly used for handling a variety of formats so that the medium may cover the whole width or only a part of the width of the platen. When only a part of the width of the platen is used, it may indeed be the case that an opening connecting the top surface of the platen to the zone of negative pressure is left uncovered by the medium, this resulting in a loss of pressure in the zone of negative pressure which would ideally have to be compensated adequately.

Hardcopy apparatuses commonly include one or more media advancing device which provides adequate means of advancing the medium. Such devices typically include a platen. A platen is to be understood as a substantially flat piece which directly supports the medium. As the invention may be applied to hardcopy devices having a high and consistent output, the speed and the reliability of the displacement of the medium onto the platen are achieved in the invention by avoiding discontinuities on the top surface of the platen.

In the prior art execution as disclosed in U.S. Pat. No. 6,786,664 such a discontinuity is produced by the shim which is located on the top surface of the platen, thereby potentially reducing the speed of output and introducing the possibility of the medium getting caught or blocked due to such a discontinuity.

According to the invention, the platen comprises at least one slot and a top surface. The slot should be understood as going all the way through the platen, meaning from the top to the bottom surface of the platen. By a slot it is meant an aperture having a substantially constant cross section, the cross section being taken in a plane perpendicular to the top surface of the platen and parallel to the direction of displacement of the medium, the slot being in an embodiment elongated in the direction perpendicular to the direction of displacement of the media. The substantially constant cross section of the slot should ideally mate the part of the revolving overdrive roller emerging through it, as will be further discussed below.

Generally speaking the platen is the piece of equipment on which the medium advances and is for this reason provided with a generally flat top surface which is designed to be in direct contact with the medium. This top surface should allow smooth movement of the surface but should also accommodate for means to maintain the medium in the desired position, more particularly means for maintaining the medium substantially flat on the top surface. The side of the mechanical piece forming the platen opposite the top surface is named the bottom surface. The bottom surface does normally not come into direct contact with the medium and is therefore not submitted to the same requirements as the top surface.

In order to ensure contact between the medium and the top surface of the platen, a plurality of openings connecting the top surface to at least one zone of negative pressure is provided. By negative pressure should be understood a pressure lower than the surrounding atmospheric pressure, typically in the range of 30 to 100 mm of H2O (water). The openings connecting the top surface to the zone of negative pressure allow a current of air to be created between the top surface of the platen in the zone of each opening and the zone of negative pressure leading to creating a local atmospheric depression onto the top surface. This depression will have a direct effect on the medium holding it down onto the top surface of the platen. The combination of the force holding the medium down onto the top surface and of the rotation of a revolving overdrive roller as discussed below will produce the displacement of the medium, generally in the direction defined by the peripheral speed of the overdrive roller.

Indeed, the device according to the invention includes a revolving overdrive roller having an outer surface, the outer surface emerging above the top surface through the slot. Generally speaking a roller should be understood as a cylindrical body of circular cross section. The axis of the roller is parallel to the plane of the top surface of the platen and in an embodiment perpendicular to the direction of displacement of the medium. The roller according to the invention is revolving, which implies that it rotates around its axis. The revolving roller is an overdrive roller, such that the medium passes over the roller, so that the outer surface of the roller comes only in contact with the bottom side of the medium which is also the side of the medium which is in contact with the platen. By outer surface of the roller it should be understood the surface of the roller parallel to the axis of the roller. It should be noted that the pieces entering in contact with the medium, in the case of the invention the top surface of the platen or the outer surface of the roller, may be made of a material exhibiting specific friction characteristics in order to improve the quality of the contact with the medium. Such friction coefficient is of about 0.7 between the platen and the medium and of about 1.2 between the overdrive roller and the medium. The coefficient of friction is defined as follows: the coefficient of friction is a dimensionless number relating the value of the friction force to the value of the force applied at the zone of friction normal to the zone of friction. In other words, when a force is applied at the zone of friction, this force has a component normal to the zone of friction, the value of which may be multiplied by the coefficient of friction to obtain the friction force.

According to the invention, the overdrive roller is substantially sealed in a housing below the top surface, meaning the top surface of the platen. This positioning below the top surface is directly related to the fact that the roller is an overdrive roller, i.e. a roller placed below the medium in opposition to a different situation where the medium would pass between a roller and a platen. In order to interact with the medium, the outer surface of the overdrive roller is emerging above the top surface of the platen. By emerging it should be understood that the highest point of the outer surface of the roller should be at a distance in the range of about 0.1 to about 0.5 mm from the top surface of the platen. In an embodiment, the distance is of 0.3 mm. The roller is placed below the top surface and emerges through the slot to come into contact with the medium. The slot in the platen is the window through which the roller sticks out in order to engage the medium. Depending on the relative values of the diameter of the roller and the thickness of the platen in the region of the slot, the roller may be entirely located in the slot (except for the emerging part) if the diameter of the roller is inferior to the thickness of the platen, or, in a particular configuration, the diameter of the roller is superior to the thickness of the platen. In an embodiment, the platen has a thickness of 3 mm, the overdrive roller a diameter of 18.1 mm and a length of 16 mm. In any case, the roller is placed substantially below the top surface. The slot should ideally mate the outer surface of the roller to which it corresponds, so that the cross section of the slot is in an embodiment based on the circular cross section of the overdrive roller, increased by a clearance allowing smooth rotation of the overdrive roller. In a particular embodiment, the clearance was of 0.5 mm laterally and in the radial direction. More generally speaking, a gap is present between the outer surface of the overdrive roller and the platen. In the case of the possible configuration where the cross section of the slot corresponds to the cross section of the roller increased by a clearance, this gap corresponds to the clearance.

According to the invention, the roller is substantially sealed in a housing, the housing separating the overdrive roller from the zone of negative pressure. As explained above, there is a gap present between the platen and the outer surface of the roller in the zone of the slot. In order to allow for adequate functioning of the negative pressure system, it is important that the zone of negative pressure is properly contained, in the sense that losses or leaks should be reduced to a minimum in order to avoid wasting energy in producing and maintaining the negative pressure. Typically, the gap discussed above is the source of leakage or losses. In order to improve containment, the housing is introduced. As the housing separates the overdrive roller from the zone of negative pressure, the atmosphere surrounding the roller is separated from the atmosphere of the negative pressure zone. The use of a housing allows thereby to release the mechanical constraints which were existing in the zone of the gap by de-coupling the problem of containment of the zone of negative pressure from the mechanical problems induced by the rotation of the overdrive roller. The housing substantially seals the overdrive roller, such that leakage or losses are reduced. It should be noted that such a structure allows keeping the zone of negative pressure contained while allowing for a large clearance allowing smooth rotation of the overdrive roller. Such clearance is to be found between the roller and the platen in the zone of the slot as well as between the roller and the housing.

In an embodiment at least one of the openings connecting the top surface to the at least one zone of negative pressure is provided in the platen. This would be the case in particular when the zone of negative pressure is located directly below the platen, the zone of negative pressure consisting typically in a vacuum chamber. It should be noted that more than one or even all of the openings may be provided in the platen. Such an opening should have a diameter of typically 2 mm. The opening may consist in a direct through hole in the platen, either perpendicular to or tilted at an angle to the top surface of the platen, or may consist in a serpentine path which may be of interest to control pressure losses. Such serpentine path may be provided by use of a foam placed in the opening for channeling the flow of air passing through it.

In another embodiment, at least one of the openings is provided in the housing. It should be noted that more than one or even all of the openings may be provided in the housing. Such an opening should have a diameter of typically 1 mm. The opening may consist in a direct through hole in the housing, either perpendicular to or tilted at an angle to the peripheral surface of the housing, or may consist in a serpentine path which may be of interest to control pressure losses. Such serpentine path may be provided by use of a foam placed in the opening for channeling the flow of air passing through it. This embodiment could be combined with the other embodiment whereby at least one of the openings is provided in the platen. Indeed, the openings could all be placed in the housing, or some only, some others being also possibly provided in the platen.

It should be noted that openings may also be provided through the roller itself. However, in an embodiment of the invention, the roller is constituted of a whole solid block, such that no openings are provided through it, thereby facilitating the manufacturing process of the roller.

In a further embodiment, the following may be provided: a plurality of slots in the platen; and a corresponding plurality of revolving overdrive rollers each having an outer surface, the outer surface of each overdrive roller emerging above the top surface through one corresponding slot, each overdrive roller being substantially sealed in a dedicated housing below the top surface, the dedicated housing separating the overdrive roller from the zone of negative pressure.

Such an embodiment is particularly suited for the handling of large format media, whereby the media may be held in place in several points. It was also found particularly suitable to use a plurality of rollers instead of a single long roller for this purpose. Furthermore, the use of a plurality of rollers provides an increased freedom of placement for such rollers, which may be aligned, but may also be placed in a staggered configuration.

It should also be noted that in an embodiment of the invention, the housings are grouped in pairs, each pair of housing being made of one single piece only, thus facilitating the manufacturing process.

In its second main aspect, the invention relates to a media advancing device for a hardcopy apparatus comprising: a platen having at least one slot, a top surface and a bottom surface, whereby a media advances on the top surface; and at least one revolving overdrive roller having an outer surface, the overdrive roller being placed below the top surface, the outer surface emerging above the top surface through the slot to come into contact with the media, a gap being present between the outer surface and the platen; and at least one opening connecting the top surface to a zone of negative pressure; and at least one shim obstructing said gap at least partially, the shim being placed against the bottom surface.

In this particular aspect, in order to control the size of the gap and to improve the containment of the zone of negative pressure, at least one shim obstructing said gap at least partially is provided. By a shim should be understood an additional mechanical piece having the function of reducing at least partially the gap between the platen and the overdrive roller. The advantages of having such a shim include the possibility of using a material different from the one used to manufacture the platen as well as a different manufacturing process allowing for example a more precise manufacture of the shim, thus allowing a reduction of the gap without consequence on the smooth rotation of the overdrive roller. In an embodiment, the platen comprises polycarbonate with glass fiber. In an embodiment, the overdrive roller comprises EPDM. In an embodiment, the shim comprises polycarbonate with fiber and PTFE.

It should be noted that the shim is placed against the bottom surface. This allows benefiting from a number of advantages. It should be understood that the design, dimensions, manufacture and fitting of a shim placed on the top surface is submitted to the constraints due to the displacement of the medium on the top surface. Such constraints disappear when the shim is placed against the bottom surface, thus providing a greater flexibility for the design, dimensioning, manufacture and fitting of the shim. The shim may for example be integrated to other mechanical pieces which should in any case be present below the bottom surface such as bearings for the overdrive roller, or may even be part of a housing for the part of the overdrive roller located below the top surface of the platen.

In an embodiment, a plurality of openings is provided. In another embodiment the top surface comprises a groove connected to the at least one of the openings. Such a groove is used to expand the area of suction of the medium. It should be noted that such grooves provided on the top surface should have a limited depth, which in an embodiment is of 1 mm, and merge substantially continuously with the top surface of the platen in the parts of the perimeter of the grooves which is not parallel do the direction of displacement of the medium in order to avoid trapping the medium into the groove. Indeed, the general direction of extension of such grooves follows in an embodiment the same direction as the direction of displacement of the medium. In another embodiment the top surface comprises a network of such grooves connected to the at least one of the openings. Such a network allows to further extend the area of influence of the opening, thus providing an improved repartition of the force for holding the medium down onto the top surface of the platen. In another embodiment, at least a part of the network of grooves surrounds at least partially the zone of the gap. Surrounding the zone of the gap with a part of the network of groove allows benefiting from the discontinuity introduced by the slot in the platen to further extend the active area. By active area, it is meant the area of the top surface in which a force is applied to the medium for holding it down on the platen. The active area is indeed best located directly around the overdrive roller, so that the medium is better held against the roller, thus increasing the friction between the roller and the medium, leading to a more efficient medium displacement.

In another embodiment, the platen comprises a plurality of slots, a plurality of overdrive rollers and a plurality of shims in order to optimize the repartition of the traction force applied by the overdrive rollers on the medium, particularly when using large format media.

In a third main aspect, the invention relates to a media advancing device for a hardcopy apparatus comprising: a platen having a plurality of slots, a top surface and a bottom surface, whereby a media advances on the top surface; and a vacuum chamber located below the bottom surface; and a plurality of openings connecting the top surface to the vacuum chamber; and a plurality of revolving overdrive rollers, whereby each slot corresponds to one or more of the revolving overdrive rollers, each revolving overdrive roller having an outer surface, each overdrive roller being located in the vacuum chamber, the outer surface of each overdrive roller emerging above the top surface through the corresponding slot, gaps being present between the outer surface of the overdrive rollers and the platen; and a plurality of housings, each housing substantially sealing a corresponding overdrive roller below the top surface, the housing separating the overdrive roller from the vacuum chamber.

In this specific aspect, a vacuum chamber is located below the bottom surface of the platen. By vacuum chamber what should be understood is a contained volume located in an embodiment directly below the bottom surface of the platen, the top surface of the platen normally forming part of the enclosure of the vacuum chamber, the chamber being maintained at a pressure lower than the atmospheric pressure. The vacuum chamber is typically running all along the platen in the direction perpendicular to the direction of displacement of the media. The vacuum chamber communicates with the top surface of the platen via a plurality of openings thus defining an active area, the openings channeling a flow of air from the top surface into the vacuum chamber, leading to the creation of a force holding the medium down onto the top surface in the active area, if a medium is located onto the active area.

In an embodiment, the vacuum chamber is divided into a plurality of sub-chambers. This may prove particularly useful when using a variety of formats for the medium, whereby some smaller formats do not cover the full length of the platen thus leaving part of the platen uncovered by the medium, the openings located in the uncovered area, if any, being an unobstructed source of air entry into the vacuum chamber which may either be compensated or lead to a loss in suction power in the active areas. The division of the chamber does indeed in such cases facilitate reduction of undesired air entry by dividing the entire vacuum chamber in compartments. In an other embodiment, the sub-chambers are separated from each other by an air flow restraining structure. In another embodiment each sub-chamber has a dedicated vacuum source. An embodiment could combine these features by providing sub-chambers separated from each other by an air flow restraining structure while each sub-chamber has a dedicated vacuum source. Such a configuration would make the whole media advancing device particularly suited to handling medium of different formats.

In its fourth main aspect, the invention relates to a media advancing device for a hardcopy apparatus comprising: a platen having a plurality of slots, a top surface and a bottom surface, whereby a media advances on the top surface; and a vacuum chamber located below the bottom surface; and a plurality of openings connecting the top surface to the vacuum chamber, at least some of the openings communicating with a groove network placed on the top surface of the platen; and a plurality of revolving overdrive rollers each having an outer surface, the overdrive rollers being supported by at least one axle, the at least one axle being supported by bearings, at least one bearing being located in the vacuum chamber, the outer surface of each overdrive roller emerging above the top surface through one of the slots, a gap remaining between the outer surface of each overdrive roller and the platen, whereby the at least one bearing located in the vacuum chamber obstructs at least partially one of said gaps.

In this particular aspect, a plurality of revolving overdrive rollers is provided, each having an outer surface, the overdrive rollers being supported by at least one axle. The rollers may all be supported by the same axle, in which case the rollers would be all aligned, for example in the direction perpendicular to the direction of displacement of the medium, the direction being parallel to the plane of the top surface of the platen, or the rollers may each be supported by a separated axle, which would provide a complete freedom of placement of the rollers on the top surface of the platen, but intermediate solutions may also be considered such as having different groups of rollers, each group being supported by one same axle.

In this particular aspect, the at least one axle is supported by bearings, at least one bearing being located in the vacuum chamber, the outer surface of each overdrive roller emerging above the top surface through one of the slots, a gap remaining between the outer surface of each overdrive roller and the platen, whereby the at least one bearing located in the vacuum chamber obstructs at least partially one of said gaps. The bearings may for example be roll bearings or pin bearings but may also be non articulated structures supporting the axle. It should be noted that in a particular execution, the bearings are part of a housing, the housing having the characteristics as described in the first aspect of the invention. At least one of the bearings is located in the vacuum chamber. It should be noted that more than one and even all of the bearings may be located in the vacuum chamber. According to this aspect of the invention, the bearing located in the vacuum chamber is used to reduce at least one of the gaps in order to improve the confinement of the vacuum chamber and thereby to better control and channel the air flowing from the top surface of the platen towards the vacuum chamber through the openings.

In an embodiment, each one of said gaps is at least partially obstructed by at least one of the bearings. In an other embodiment, at least one of the openings is provided at the interface between the at least one axle and at least one of the bearings.

In its fifth main aspect, the invention relates to a method of displacing a medium onto the top surface of a platen comprising: advancing the medium onto the top surface of a platen to bring it into contact with an overdrive roller, the roller being located in a substantially sealed cavity below the top surface, the roller emerging above the top surface; and inducing a flow of air between the cavity and a vacuum chamber via an opening, whereby the pressure in the vacuum chamber is inferior to the pressure in the cavity and whereby the pressure in the cavity is inferior to the atmospheric pressure; and rotating the revolving overdrive roller.

According to this invention, the overdrive roller is located in a substantially sealed cavity. This cavity has an internal volume in which the roller is housed, the roller emerging above the top surface so that the cavity opens towards the top surface to allow the emerging of the roller, the cavity being otherwise substantially sealed. The aim is to confine the roller in that there is, as far as possible, no undesired or uncontrolled air flow through the cavity. In this way a controlled flow of air may be induced from the surrounding atmosphere to the cavity and thereafter from the cavity to the vacuum chamber using an opening. The opening may be located in a variety of places, such as in the wall of the cavity itself, or in the platen, or at an interface between the cavity wall and the platen, as long as the opening induces the desired flow of air. The induced flow of air will be the source of a depression which will create a force holding the medium down onto the top surface of the platen so that there is friction between the roller and the medium in order to advance the medium. This method allows confining the overdrive roller so that the air flow is adequately controlled and so that undesired pressure losses are avoided.

In an embodiment, the peripheral speed of the overdrive roller is higher than the speed of displacement of the medium. In an embodiment, the peripheral speed of the overdrive roller is 7% higher than the speed of displacement of the medium.

It should be noted that the features of the embodiments of the various main aspects of the invention of the invention may be combined to lead to other embodiments of the invention.

The present invention will be described further, by way of example only, with reference to an embodiment thereof as illustrated in the accompanying drawings.

DESCRIPTION OF AN EMBODIMENT

Figure 1:
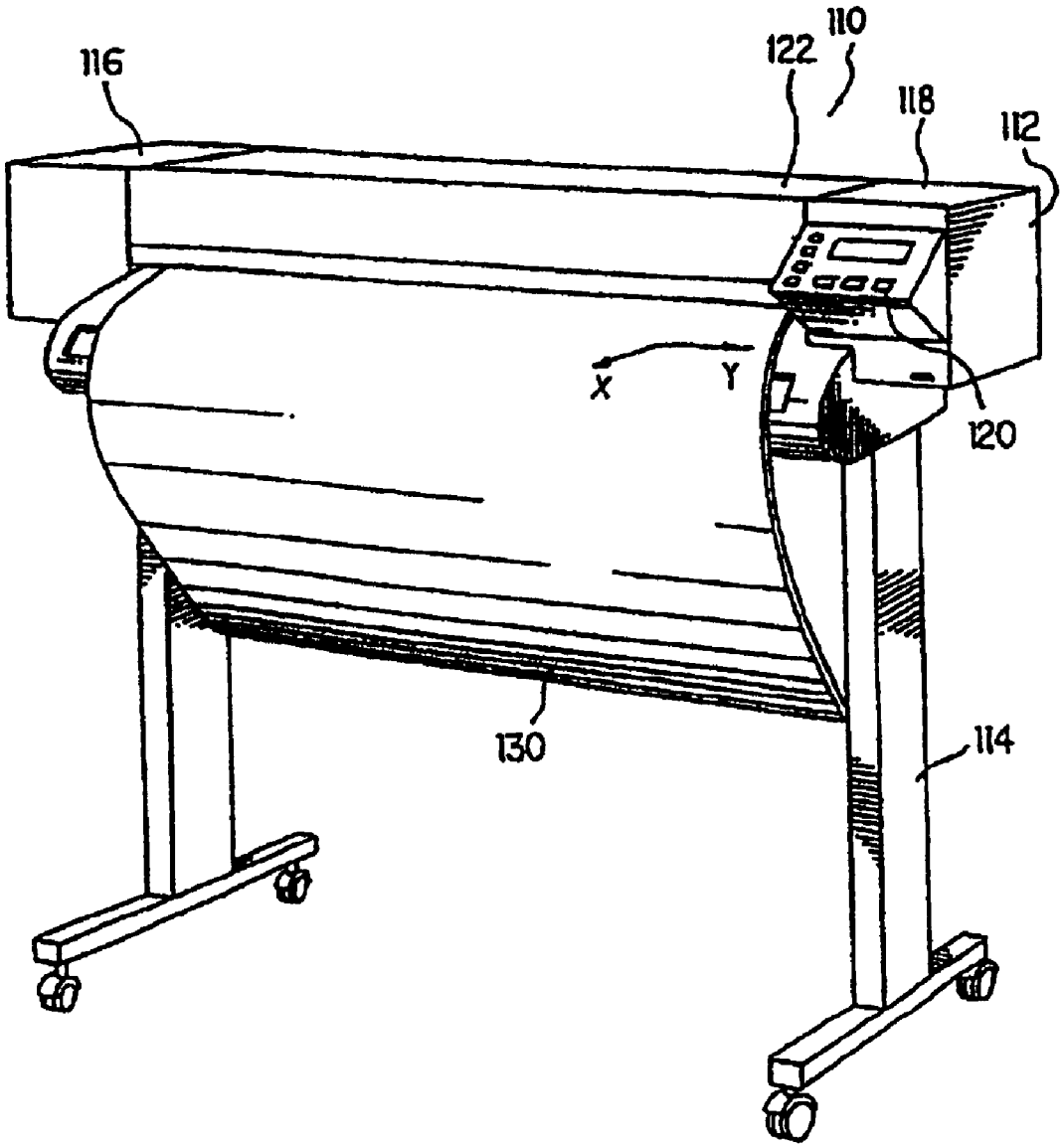
FIG. 1 is a perspective view of an inkjet printer incorporating the features of the present invention.

Referring to FIG. 1, a printer 110 includes a housing 112 mounted on a stand 114. The housing has left and right drive mechanism enclosures 116 and 118, and a cover 122. A control panel 120 is mounted on the right enclosure 118. A print media 130, such as media, is positioned along a media axis denoted as the X axis. A second axis, perpendicular to the X axis, is denoted as the Y axis.

Figure 2:
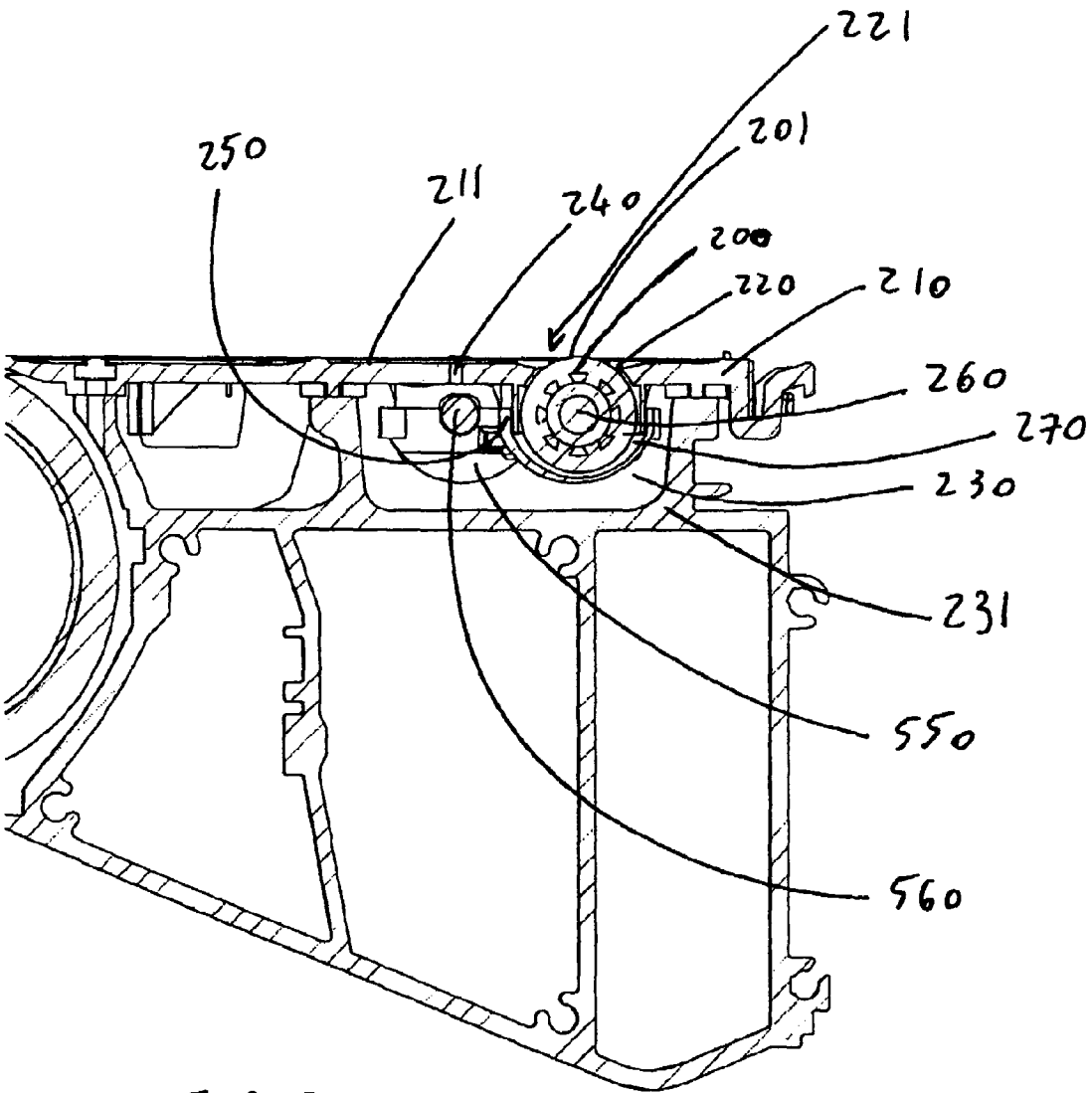
FIG. 2 is a section view of an inkjet printer incorporating the features of the invention.

Referring to FIG. 2, a section view of an inkjet printer incorporating the features of the invention is represented where an overdrive roller 200 placed below a platen 210, the platen comprising a slot 221 through which the outer surface 201 of the roller emerges leaving a gap 220 between the outer surface and the slot. A vacuum chamber or zone of negative pressure 230 enclosed by a vacuum chamber cover 231 is placed below the platen and an opening 240 is provided into the platen to connect the top surface 211 of the platen to the vacuum chamber 230. The overdrive roller is placed in a housing 250, the housing 250 serving also as a bearing for axle 260. The housing allows substantially confining the cavity 270 in which the overdrive roller is lodged so that the main communication between the top surface 211 and the vacuum chamber 230 is the opening 240.

Figure 3:
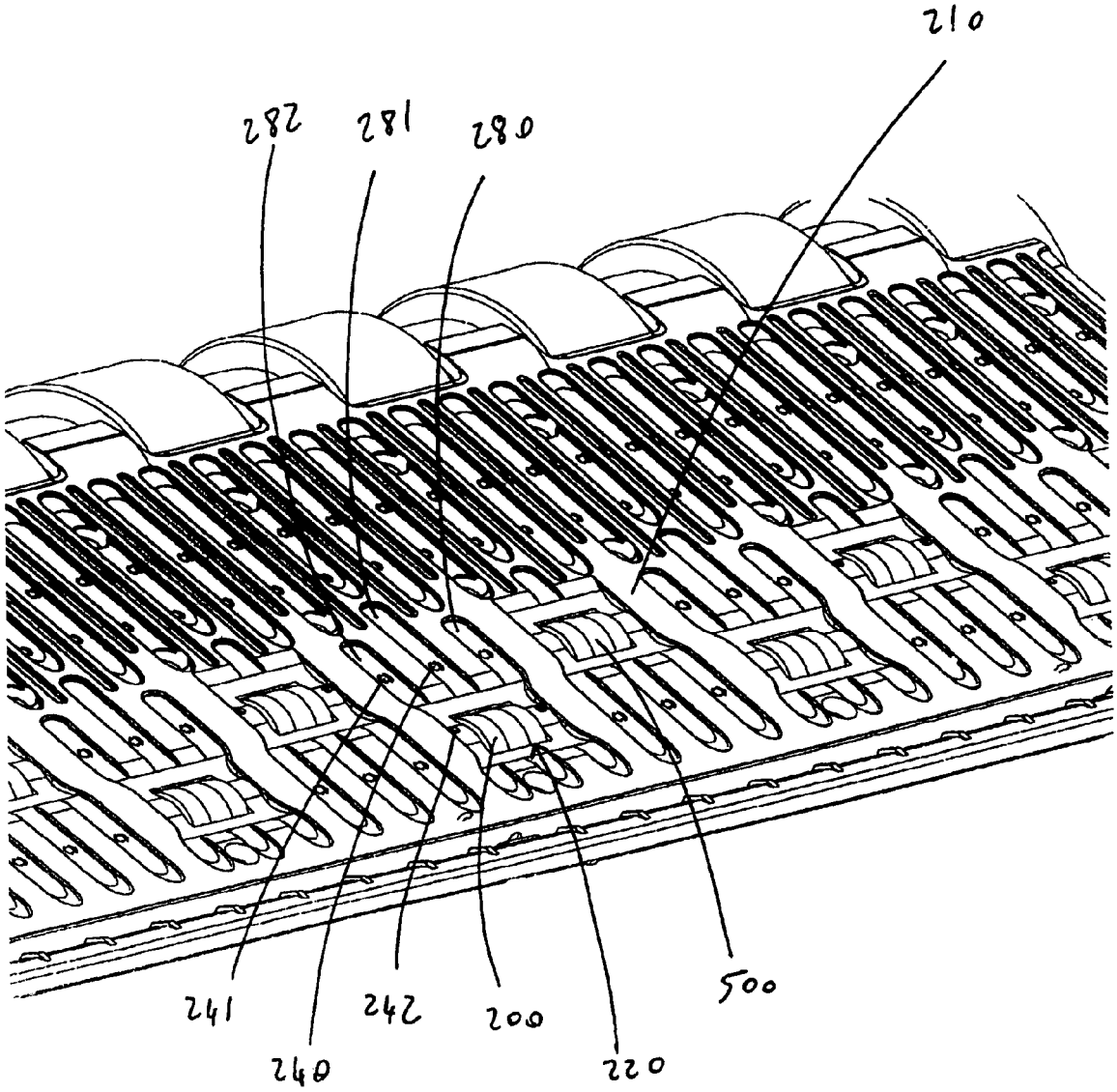
FIG. 3 is a top view of the embodiment represented in the section of FIG. 2.

Referring to FIG. 3, the same embodiment as represented in FIG. 2 is seen from the top. It can be seen that a platen has a plurality of overdrive rollers such as 200 and 500 and a plurality of openings such as 240, 241 or 242. It should be noted that the housing 550 and the axle 560 of the roller 500 is visible on the section of FIG. 2. This embodiment further comprises a network of interconnecting grooves 280, 281 and 282 which extend along the direction of displacement of the medium, the grooves being connected to the openings 240, 241 and 242 as well as other openings between the vacuum chamber and the top surface, the network surrounding the zone of the gap 220.

Figure 4:
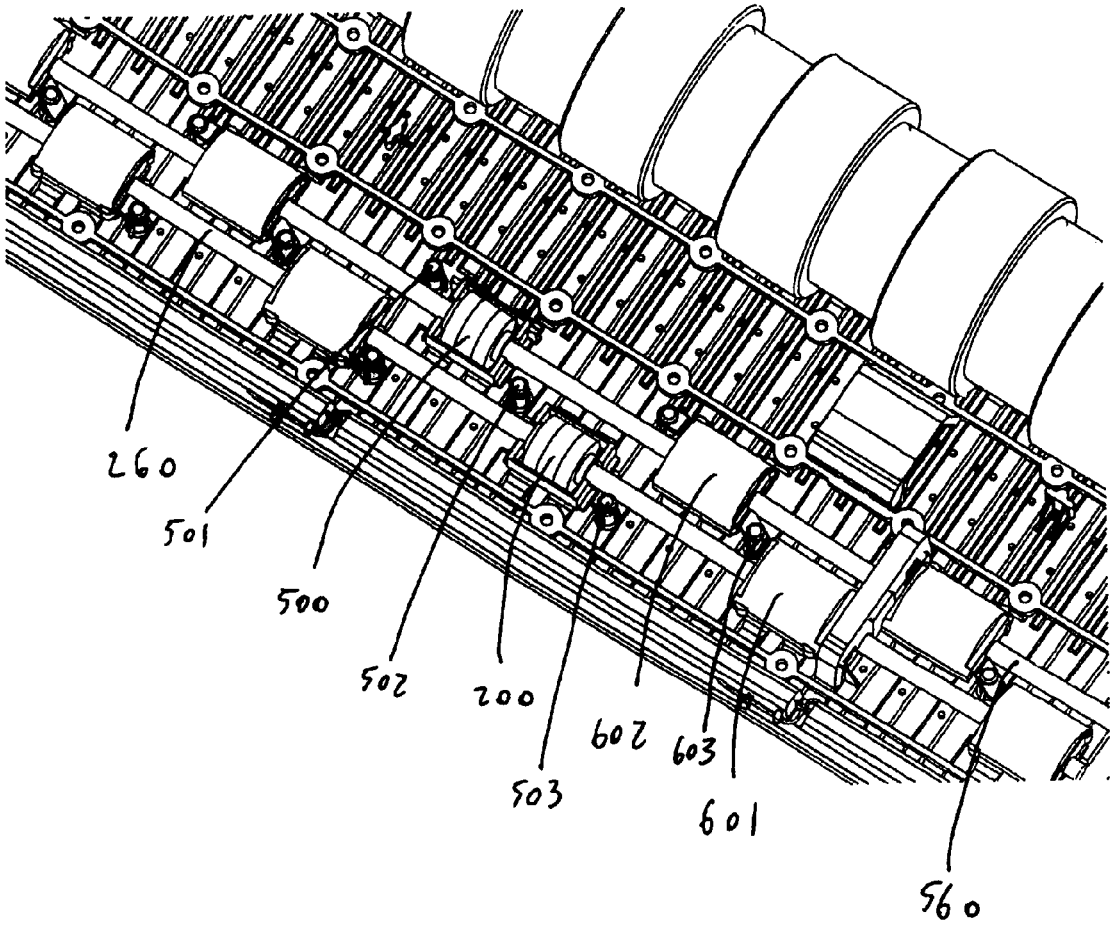
FIG. 4 is a bottom view of the embodiment represented in the section of FIG. 2

Referring to FIG. 4, the same embodiment as represented in FIGS. 2 and 3 is seen from the bottom, the cover 231 of the vacuum chamber 230, the housing 250 and the housing 550 being removed. It should be noted that in this particular embodiment the housings 250 and 500 are made of a single piece which is of the same type as the single piece comprising the housing 601, the housing 602 and the link 603 thus allowing placement of two housings using 3 screws only (note the presence of screw holes 501, 502 and 503). As mentioned above, in this configuration the housing also serves as bearing for the axles 260 and 560.

Figure 5:
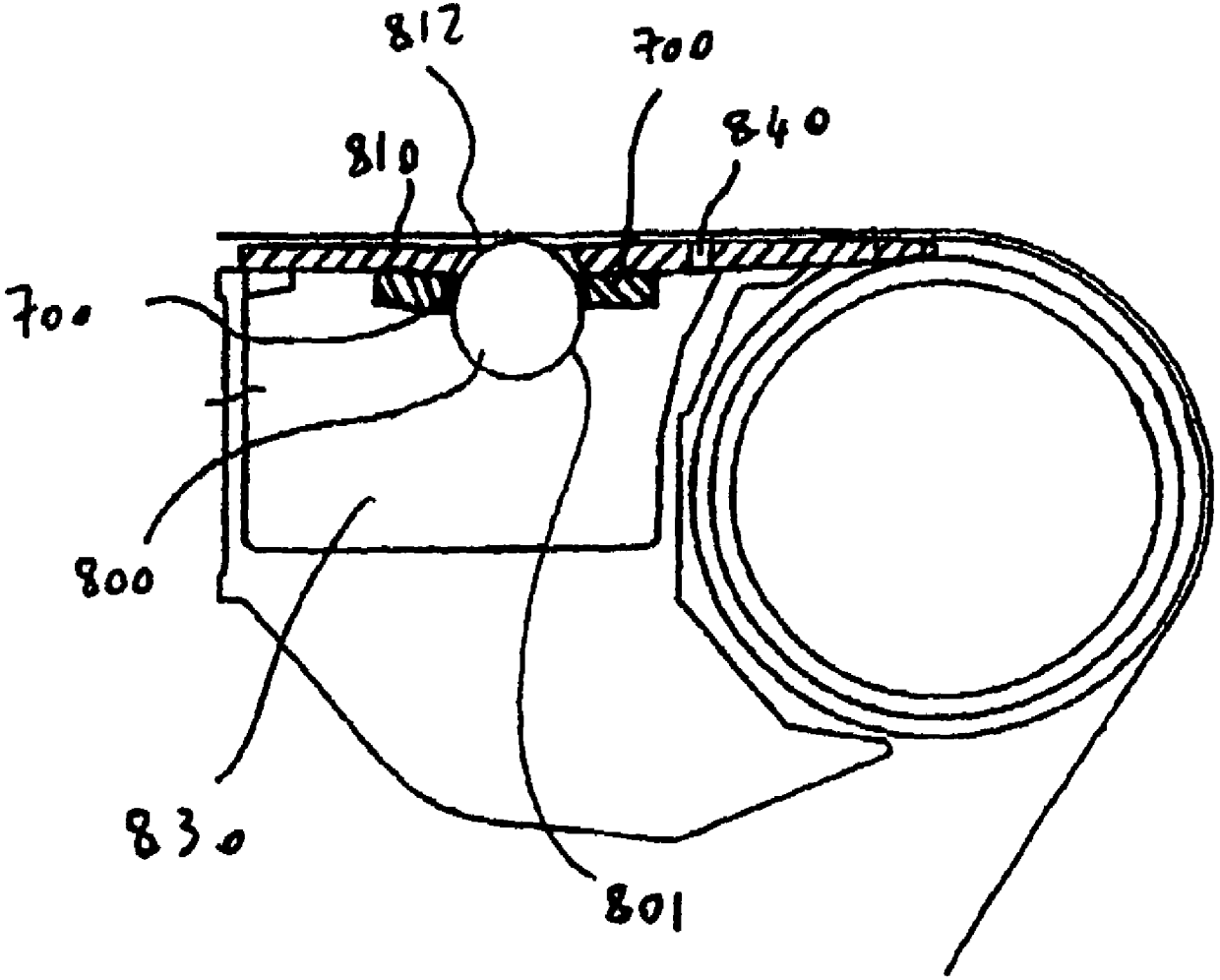
FIG. 5 is a section view of an alternative embodiment of the invention

Referring to FIG. 5, a different embodiment is represented whereby a shim 700 is placed below the platen, in such a manner that the gap between the shim 700 and the outer surface 801 of the overdrive roller 800 may be reduced to a minimum compared to the gap between the platen 810 and the outer surface 801. Such a structure allows an improved control of the communication between the vacuum chamber or zone of negative pressure 830 and the top surface of the platen 810, such communication consisting in a flow of air going through aperture 840.

The present invention having thus been described with particular reference to embodiments thereof, it will be obvious that various changes and modifications may be made therein without departing from the spirit and scope of the present invention as defined in the appended claims.

The invention claimed is:

1. A media advancing device for a hardcopy apparatus comprising:

a platen having a plurality of slots and a top surface, whereby a medium advances on the top surface; and a plurality of openings in the platen connecting the top surface to at least one zone of negative pressure; and a plurality of revolving overdrive rollers corresponding to the plurality of slots, each having an outer surface, the outer surface of each of the overdrive rollers emerging above the top surface through a corresponding slot, each overdrive roller being substantially sealed in a respective dedicated housing below the top surface, the respective dedicated housing separating the overdrive roller from the zone of negative pressure.

2. A media advancing device according to claim 1, whereby at least one of the openings is provided in the platen.

3. A media advancing device according to claim 1, whereby the top surface comprises a groove connected to the at least one of the openings.

4. A media advancing device according to claim 1, whereby the top surface comprises a network of grooves connected to the openings.

5. A media advancing device according to claim 4, whereby at least a part of the network of grooves surrounds at least partially the gap.

6. A media advancing device according to claim 1, wherein the overdrive roller is substantially sealed by structure of the device that closely contours the outer diameter of the overdrive roller.

7. A media advancing device for a hardcopy apparatus comprising:

a platen having a plurality of slots, a top surface and a bottom surface, whereby a media advances on the top surface; and a vacuum chamber located below the bottom surface; and a plurality of openings in the platen connecting the top surface to the vacuum chamber; and a plurality of revolving overdrive rollers, whereby each slot corresponds to one or more of the revolving overdrive rollers, each revolving overdrive roller having an outer surface, each overdrive roller being located in the vacuum chamber, the outer surface of each overdrive roller emerging above the top surface through the corresponding slot, gaps being present between the outer surface of the overdrive rollers and the platen; and a plurality of housings, each housing substantially sealing a corresponding overdrive roller below the top surface, the housing separating the overdrive roller from the vacuum chamber.

8. A media advancing device according to claim 7, whereby the vacuum chamber is divided into a plurality of sub-chambers.

9. A media advancing device according to claim 8, whereby the sub-chambers are separated from each other by an air flow restraining structure.

10. A media advancing device according to claim 8, whereby each sub-chamber has a dedicated vacuum source.

11. A media advancing device for a hardcopy apparatus comprising:

a platen having a plurality of slots, a top surface and a bottom surface, whereby a media advances on the top surface; and a vacuum chamber located below the bottom surface; and a plurality of openings in the platen connecting the top surface to the vacuum chamber, at least some of the openings communicating with a groove network placed on the top surface of the platen; and a plurality of revolving overdrive rollers each having an outer surface, the overdrive rollers being supported by at least one axle, the at least one axle being supported by bearings, at least one bearing being located in the vacuum chamber, the outer surface of each overdrive roller emerging above the top surface through one of the slots, a gap remaining between the outer surface of each overdrive roller and the platen, whereby the at least one bearing located in the vacuum chamber obstructs at least partially one of said gaps, and a plurality of housings, each housing substantially sealing a corresponding revolving overdrive roller below the top surface, the respective housing separating the respective overdrive roller from the vacuum chamber.

12. A media advancing device according to claim 11, whereby each one of said gaps is at least partially obstructed by at least one of the bearings.

13. A media advancing device according to claim 12, whereby at least one of the openings is provided at the interface between the at least one axle and at least one of the bearings.

* * * * *